US011422509B2

(12) United States Patent
Verdon

(10) Patent No.: US 11,422,509 B2
(45) Date of Patent: Aug. 23, 2022

(54) WATCH

(71) Applicant: Montres Rado SA, Lengnau (CH)

(72) Inventor: Christian Verdon, Les Clées (CH)

(73) Assignee: Montres Rado SA, Lengnau (CH)

( * ) Notice: Subject to any disclaimer, the term of this patent is extended or adjusted under 35 U.S.C. 154(b) by 531 days.

(21) Appl. No.: 16/495,168

(22) PCT Filed: Mar. 7, 2018

(86) PCT No.: PCT/EP2018/055530
§ 371 (c)(1),
(2) Date: Sep. 18, 2019

(87) PCT Pub. No.: WO2018/172068
PCT Pub. Date: Sep. 27, 2018

(65) Prior Publication Data

US 2020/0409309 A1 Dec. 31, 2020

(30) Foreign Application Priority Data

Mar. 21, 2017 (EP) ..... 17162066

(51) Int. Cl.
*G04B 45/02* (2006.01)
*G04B 19/12* (2006.01)
*G04B 39/00* (2006.01)

(52) U.S. Cl.
CPC ..... *G04B 45/02* (2013.01); *G04B 19/12* (2013.01); *G04B 39/002* (2013.01); *G04B 39/004* (2013.01)

(58) Field of Classification Search
CPC ..... G04B 19/12; G04B 45/02; G04B 39/002; G04B 39/004
See application file for complete search history.

(56) References Cited

U.S. PATENT DOCUMENTS 5,238,981 A 8/1993 Knowles
5,369,158 A 11/1994 Knowles
(Continued)

FOREIGN PATENT DOCUMENTS

JP 3140649 U 3/2008
JP 3140649 U 4/2008
JP 2011-203213 A 10/2011

OTHER PUBLICATIONS

Combined Chinese Office Action and Search Report dated Oct. 16, 2020, in Chinese Patent Application No. 201880019275.6 (with English translation), 11 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A skeleton watch includes a horological movement housed in a watch case, the horological movement being arranged to rotate at least one hand, the horological movement being covered by a dial, and the dial being disposed between the horological movement and the at least one hand. The dial includes a photochromic plate so that the horological movement is visible when the photochromic plate is exposed to an amount of UV radiation below a first threshold value and the horological movement is masked when the photochromic plate is exposed to an amount of UV radiation above a second threshold value.

10 Claims, 1 Drawing Sheet

(56) References Cited

U.S. PATENT DOCUMENTS

| | | | | |
|---|---|---|---|---|
| 6,466,522 | B1 * | 10/2002 | Yoshioka | G04B 19/32 368/205 |
| 6,569,919 | B1 | 5/2003 | Noguchi et al. | |
| 6,806,644 | B2 * | 10/2004 | Ueno | G02F 1/133617 368/227 |
| 7,095,463 | B2 * | 8/2006 | Usui | G02F 1/133617 362/23.18 |

OTHER PUBLICATIONS

Korean Office Action dated Nov. 27, 2020 in Korean Patent Application No. 10-2019-7027512 (with English translation), 8 pages.
Yang Hongxing, et al. "Photochromic Glass Types" Green Building Development and Renewable Resource Application, Dec. 31, 2016, 4 pages.
"Transparent Functional Composite Material" Aeronautical Composite Material Technology, Dec. 31, 2013, 3 pages.
Du Jinghong, et al., "Photochromic Glass" Inorganic Nonmetal Material Science, Aug. 31, 2016, 3 pages.
Japanese Office Action dated Jul. 21, 2020 in Japanese Application 2019-572283 (with English Translation), 4 pages.
International Search Report dated Jun. 14, 2018 in PCT/EP2018/055530 filed on Mar. 7, 2018.

* cited by examiner

WATCH

CROSS-REFERENCE TO RELATED APPLICATIONS

The present application is a national stage entry of International Application No. PCT/EP2018/055530, filed Mar. 7, 2018, which claims priority to European Patent Application No. 17162066.9, filed on Mar. 21, 2017, the entire content and disclosure of which are incorporated by reference herein.

FIELD OF THE INVENTION

The invention relates to a watch, in particular a so-called skeleton watch.

BACKGROUND OF THE INVENTION

In skeleton watches of the prior art, the dial of the watch may be omitted, or made from a transparent material or from a perforated plate, so as to reveal the horological movement behind the dial.

Such watches are aesthetically pleasing but, when it is very bright, it is difficult to read the time since the hands have low contrast compared with the horological movement.

Furthermore, it is difficult to have a legible logo on a skeleton watch, especially when it is very bright.

SUMMARY OF THE INVENTION

The invention aims to remedy the drawbacks of the prior art by proposing a watch, in particular a skeleton watch, making it possible to read the time and any logo more easily whatever the brightness conditions.

To do this, according to a first aspect of the invention, a watch is proposed comprising a horological movement housed in a watch case formed by a middle part, closed by a crystal and a bottom, the horological movement being arranged to rotate at least one hand, the horological movement being covered by a dial visible through the crystal, the dial being disposed between the horological movement and said at least one hand, the watch being characterised in that the crystal is transparent to UV rays and in that the dial consists of a photochromic plate so that:

- the horological movement is visible when the photochromic plate is exposed to an amount of UV radiation below a first threshold value,
- the horological movement is masked when the photochromic plate is exposed to an amount of UV radiation above a second threshold value.

This is because the photochromic plate darkens under the effect of UV radiation, and lightens under the effect of ambient heat, and this in an indefinitely reversible manner. Thus, when the watch is not exposed to UV radiation, typically when the watch is worn indoors, the horological movement is visible behind the dial since the photochromic plate is transparent to the visible spectrum. On the other hand, when the photochromic plate is exposed to UV radiation, the dial darkens. The more the watch dial is exposed to a large amount of UV radiation, the more it darkens until it becomes opaque, which enables the hands to appear clearly by contrast with the opaque dial of the watch.

The first threshold value and the second threshold value are dependent on the material or materials chosen for the photochromic plate.

The watch according to the first aspect of the invention may also have one or more of the following features taken individually or in all technically possible combinations:

- the photochromic plate may be a plate made from a material transparent to UV rays comprising in its mass inclusions of photochromic materials;
- the photochromic plate may be a plate made from a transparent material coated with a photochromic layer in the form of a polymer film including photochromic material or a paint including pigments of photochromic material;
- the material transparent to UV rays may be a mineral glass;
- the material transparent to UV rays may be an organic glass;
- the transparent material may be an organic resin, typically an acrylic resin or a polycarbonate resin transparent to UV radiation;
- the photochromic inclusions may, preferably in the case of mineral glasses, be inclusions of a silver halide and/or silver bromide compound;
- the photochromic inclusions may, preferably in the case of organic glasses, typically be a synthetic resin, preferably acrylic resin or a polycarbonate resin, with inclusions of oxazine molecules and/or of naphthopyrane compounds;
- the photosensitive plate may comprise an inscription printed or etched on at least one of these faces;
- the dial may have a black colour when the photochromic plate is exposed to an amount of UV radiation higher than the second threshold value, so as to make the time more legible;
- the hand or hands may be white so as to be more visible when the dial darkens.

SUMMARY DESCRIPTION OF THE DRAWINGS

Other particularities and advantages will emerge clearly from the description that is given thereof below, by way of indication and in no way limitatively, with reference to the accompanying drawings, in which.

DETAILED DESCRIPTION OF AN EMBODIMENT

Figure 1:
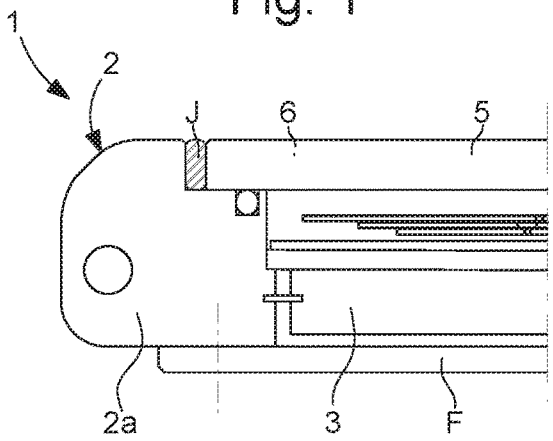
FIG. 1 shows a schematic view in half-section of a watch according to one embodiment of the invention.

A watch 1 according to an embodiment of the invention will now be described with reference to FIGS. 1 to 4.

This watch 1 comprises a watch case 2 that contains a horological movement 3. The case 2 comprises a middle part 2*a*, and a first and second element closing the case, respectively a crystal 5 and a bottom F. The middle part 16 is provided with four horns for fixing the bracelet B. The bottom F is fixed to the middle part 2*a* by means of screws, not shown in the drawing, and the crystal 5 is conventionally wedged in a recess in the middle part with the interposing of a seal. The crystal is produced from a material transparent to UV rays.

The horological movement 3 rotates the hands 4. The watch 1 also comprises a dial 5. The dial 5 closes the watch case 2. The dial 5 is disposed directly above the horological movement 3. The dial 5 is therefore interposed between the horological movement 3 and the hands 4.

The hands 4 preferably have a light colour, typically white, so as to be more visible on the dial.

The dial 5 is formed by a photochromic plate 6 disposed directly above the horological movement 3 and directly below the hands 4. The photochromic plate 6 comprises a plate made from a transparent material in which photochromic substances are included or which is coated with a coating containing photochromic substances.

The photochromic plate 6 darkens under the effect of UV radiation and lightens under the effect of ambient heat, and this in an indefinitely reversible manner. This phenomenon is obtained by activation of molecules of photochromic substances. The absorption of the photochromic plate is determined at any moment by equilibrium between the number of photosensitive molecules activated by the UV stimulation and the number of molecules deactivated by heat.

According to one embodiment, the photochromic plate 6 is formed by a synthetic resin, preferably a polycarbonate resin or an acrylic resin transparent to UV radiation, in which molecules of oxazines and/or naphthopyrane compounds are dispersed within the resin. Typically the thickness of the plate is around 0.85 mm.

According to one variant, the photochromic plate is a plate made from a material transparent to radiation coated with a photochromic layer in the form of a polymer film including photochromic material identical to that described in the paragraph above.

The phenomenon of darkening and lightening of this type of plate is well known and results respectively from the rupturing of the molecules of oxazines and/or naphthopyrane compounds under the effect of UV rays and reconstitution thereof when the UV has disappeared.

According to another variant, the photochromic plate is a mineral glass in which the photochromic inclusions are inclusions of a silver halide and/or silver bromide compound. In this case, under exposure to UV, the silver-halide/bromide bonds rupture and the silver atoms combine with each other, which darkens the plate. The silver-halide bonds are reconstituted as soon as exposure to UV stops, giving clarity to the plate again.

Moreover, an inscription 7 may be etched or printed on the dial.

Figure 2:
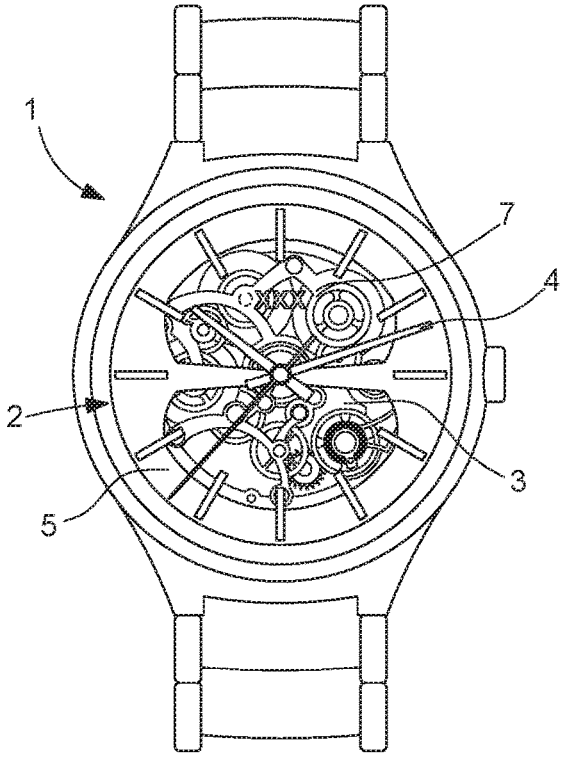
FIG. 2 shows a schematic plan view of the watch in FIG. 1 when it is exposed to an amount of UV below a first threshold value.
Figure 3:
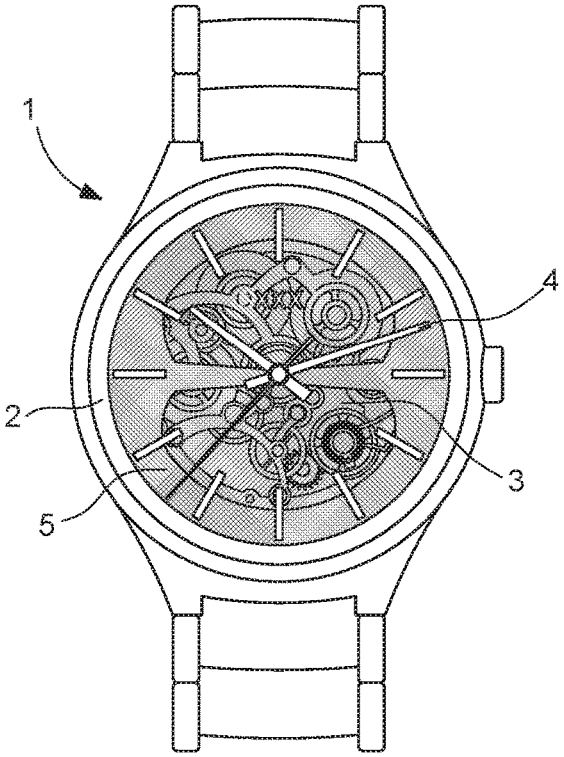
FIG. 3 shows a schematic plan view of the watch of FIG. 1 when it is exposed to an amount of UV lying between the first threshold value and the second threshold value.
Figure 4:
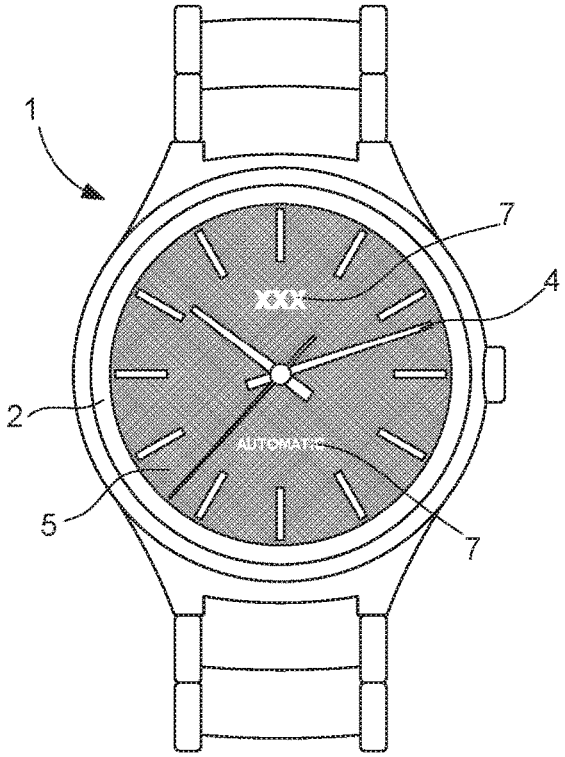
FIG. 4 shows a schematic plan view of the watch in FIG. 1 when it is exposed to an amount of UV above the second threshold value.

FIGS. 2 to 4 show the change in the colour of the dial 5 according to the exposure thereof to UV rays.

Thus FIG. 2 shows the watch when it is not exposed to UV rays. As can be seen in this figure, the dial is then transparent so that the horological movement is visible through the dial.

FIG. 3 shows the watch when it is exposed to a small amount of UV. This amount of UV is typically between the first threshold value and the second threshold value. In this case, the dial is partially darkened, so that the horological movement is partially visible through the dial. Furthermore, the hands 4 and the inscription 7 begin to appear by contrast so as to be legible despite the increase in brightness. This is because the darkening of the dial limits the reflections related to the horological movement.

FIG. 4 shows the watch when it is exposed to an amount of UV greater than the second threshold amount. In this case, the dial has adopted a dark colour so that it completely masks the horological movement. The hands 4 and the inscription 7 are then highly visible, despite high brightness.

Naturally the invention is not limited to the embodiments described with reference to the figures and variants could be envisaged without departing from the scope of the invention. Thus indices could for example be etched or printed on the photochromic plate, which would make it possible to have a skeleton watch with visible indices while dispensing with any highlight. The dial could also have forms other than that shown.

The invention claimed is:

1. A watch comprising:

a horological movement housed in a watch case formed by a middle part, a crystal and a bottom, the horological movement being arranged to rotate at least one hand, the horological movement being covered by a dial visible through the crystal, the dial being disposed between the horological movement and said at least one hand, wherein the crystal is transparent to UV rays and the dial includes a photochromic plate so that:

the horological movement is visible when the photochromic plate is exposed to an amount of UV radiation below a first threshold value, and the horological movement is masked when the photochromic plate is exposed to an amount of UV radiation above a second threshold value.

2. The watch according to claim 1, wherein the photochromic plate is a plate made from a material transparent to UV rays comprising within said material inclusions of photochromic materials.

3. The watch according to claim 1, wherein the photochromic plate is a plate made from a transparent material coated with a photochromic layer in the form of a polymer film including photochromic material.

4. The watch according to claim 2, wherein the material transparent to UV rays is a mineral glass.

5. The watch according to claim 2, wherein the material transparent to UV rays is an organic glass.

6. The watch according to claim 5, wherein the transparent material is a synthetic resin, preferably a polycarbonate resin or an acrylic resin transparent to UV rays.

7. The watch according to claim 5, wherein the transparent material is a polycarbonate resin or an acrylic resin transparent to UV rays.

8. The watch according to claim 2, wherein the photochromic inclusions are inclusions of a silver halide and/or silver bromide compound.

9. The watch according to claim 2, wherein the photochromic inclusions are inclusions of oxazine molecules and/or of naphthopyrane compounds.

10. The watch according to claim 1, wherein the photosensitive plate comprises an inscription printed or etched on at least one face.

* * * * *